US005527100A

United States Patent [19]

O'Donnell et al.

[11] Patent Number: 5,527,100

[45] Date of Patent: Jun. 18, 1996

[54] COMPOSITE WHEEL FOR IN-LINE ROLLER SKATE

[76] Inventors: Patrick J. O'Donnell, 6236 Hasbrook Ave. 2nd Floor, Philadelphia, Pa. 19111; Steven C. Preston, 96 Fletcher Rd., Bedford, Mass. 01730

[21] Appl. No.: 398,004

[22] Filed: Mar. 3, 1995

Related U.S. Application Data

[63] Continuation-in-part of Ser. No. 134,167, Oct. 8, 1993.

[51] Int. Cl.[6] ..... A63C 17/14

[52] U.S. Cl. ..... 301/5.3; 301/64.7

[58] Field of Search ..... 301/5.3, 5.7, 64.7; 280/11.19, 11.22, 11.23

[56] References Cited

U.S. PATENT DOCUMENTS

| | | | |
|---|---|---|---|
| 1,687,113 | 10/1928 | Stockdale | 301/5.3 X |
| 5,129,709 | 7/1992 | Klamer | 301/5.3 |
| 5,401,037 | 3/1995 | O'Donnell et al. | 280/11.22 X |

FOREIGN PATENT DOCUMENTS

| | | | |
|---|---|---|---|
| 1031192 | 5/1958 | Germany | 301/5.3 |
| 30102 | of 1909 | United Kingdom | 301/5.3 |

*Primary Examiner*—Russell D. Stormer
*Attorney, Agent, or Firm*—Michael Ebert

[57] ABSTRACT

In-line roller skates capable of riding at high speed on a skating surface and of being braked by the skater without the need for braking pads or similar expedients for this purpose. Each skate is provided with a set of composite wheels supported for rotation in tandem on a frame secured to the underside of a boot. Each composite wheel includes a central section, a substantial portion of which is formed of a synthetic plastic material exhibiting a low coefficient of sliding friction having a slippery outer surface, the central section being flanked by side sections formed of a synthetic plastic material exhibiting a higher coefficient of sliding friction providing a slip-resistant outer surface. The relative values of the coefficient of sliding friction are such that when the skater travels in the forward direction, the skate wheels then roll on the skating surface, and when the skater wishes to slow down or brake, he then angles the skates with respect to the direction of forward motion, thereby causing the wheels to slide on their central section on the skating surface and causing the side sections to frictionally engage this surface to slow down the slide and thereby effect a braking action.

7 Claims, 3 Drawing Sheets

COMPOSITE WHEEL FOR IN-LINE ROLLER SKATE

RELATED APPLICATIONS

This application is a continuation-in-part of our copending application of the same title, Ser. No. 08/134,167, filed on Oct. 8, 1993, the entire disclosure of which is incorporated herein by reference.

BACKGROUND OF INVENTION

1. Field of Invention

This invention relates generally to in-line roller skates, and more particularly to composite wheels for such skates which make it possible to skate at high speed on a skating surface, yet to slow down and stop easily without the need for a brake pad or other special expedients for this purpose.

2. Status of Prior Art

In-line roller skates are often referred to as ROLLERBLADE skates, this being the trademark for the best known brand of such skates. In a skate of this type, each foot of the skater is received in a boot having attached to its underside a frame supporting for rotation a set of wheels in tandem relation. In an in-line roller skate the wheels are aligned in a single row rather than in parallel rows as in a conventional quad roller skate. The in-line wheels are so shaped and placed as to allow tilting of the skate as much as thirty degrees from the vertical without substantially reducing the ground contact area of the wheels.

Using standard in-line roller skates, a skilled skater can attain speeds exceeding 30 miles per hour on a flat pavement, or a wood, asphalt, plastic or other skating surface, a far greater speed than is achievable with conventional quad roller skates. These high speeds make it difficult and sometimes dangerous for the skater to quickly brake, rather than slowly brake, particularly when faced with an unexpected obstacle requiring the skater to come to an abrupt halt to avoid a collision.

According to American Sports Data, in-line roller skating is the fastest growing sport in the United States. As more in-line skaters take to the road, skating-related injuries continue to rise. It is generally recognized that the key to safe in-line roller skating is effective stopping and speed control, and that most accidents occur because of the inability of the skater to brake without losing his balance.

In standard in-line roller skates, mounted at the rear of the right skate is a heel brake provided with a soft rubber pad. To effect stopping, the skater must shift most of his weight onto the non-braking left skate while upwardly tilting the toe of his right skate and pressing the heel brake against the road surface.

This braking maneuver is difficult to execute. As a consequence, inexperienced in-line roller skaters who have difficulty controlling their speed, usually lose their balance when trying to operate the heel brake. These novice skaters may then resort to a crash landing or to spilling onto the grass or dirt on the side of the road. In either case, the skater may suffer broken wrists and arms, fractured shoulders or collar bones, or experience back and ankle sprains.

Many experienced and skillful in-line roller skaters tend not to use the heel brake and, in some instances, they actually detach the brake from the skate. What these skilled skaters do is to use a so-called T-stop maneuver in which the skater drags the wheels of one skate so that it is perpendicular to the other.

The T-stop braking maneuver can wear out a set of wheels in two or three months, depending on the roughness of the road surface. And skaters who frequently brake downhill by using the T-stop maneuver, will find themselves in the need of a new set of wheels in short order. Since a new set of wheels currently costs at least 50 dollars, and in some instances, much more, the T-stop maneuver is one few skaters can afford.

The 1993 patent to Landers, U.S. Pat. No. 5,207,438, calls attention to the drawbacks of existing in-line roller skates having a rear braking pad. As noted in this patent, the brake pad requires the skater to execute an awkward, out-of-balance foot maneuver. Lander's solution to this problem resides in a braking system positioned in the toe portion of the boot. This system includes a rotatable cylinder placed between a pair of brackets, the cylinder rotating in contact with the brackets to produce a frictional force when the cylinder makes contact with the ground.

The 1993 patent to Roberts, U.S. Pat. No. 5,197,572, provides at the rear of an in-line roller skate a cast brake shoe on which a replaceable rubber pad is mounted. Roberts points out that in-line skaters sometimes resort to the same type of action as ice skaters do in stopping forward motion. The same point is made in the 1993 patent to Dettmer, U.S. Pat. No. 5,171,032, who further notes that side slipping, i.e., where ice skates are pointed perpendicularly to the skates direction of movement, would wear flat spots on in-line roller skate wheels which are then rendered unusable.

Thus while Dettmer considers the possibility of using in-line skate wheels to effect braking in the manner of ice skates, he dismisses this maneuver as causing unacceptable wheel wear. Instead, he provided brake pads in the spaces between the wheel and a cable connected to a hand-held lever to actuate the pads.

The 1992 patent to Allison, U.S. Pat. No. 5,135,244, discloses an in-line roller skate having a leaf spring adapted to frictionally engage a forward or rear wheel to impede wheel rotation. The 1993 patent to Hoskin, U.S. Pat. No. 5,183,275, discloses an articulated mounting on an in-line roller skate frame that movably mounts a roller for selective engagement with the rear wheel of the skate and a ground-engaging brake pad arrangement that serves to actuate the mounting to move the roller into contact with the skate wheel and apply a braking force thereto as well as to the skate itself.

Also of background interest is the 1991 patent to Olson U.S. Pat. No. 5,028,058 (assigned to Rollerblade, Inc.) which makes reference to a 1966 patent U.S. Pat. No. 3,287,023 to Ware disclosing an inline skate with thin, rounded wheels adapted to simulate the performance of ice skates. The Ware skate makes use of a wheel formed of firm but slightly soft and resilient rubber, and a toe brake at the front end of the skate to effect stopping.

Our copending patent application discloses in-line roller skates capable of riding at high speed on a skating surface and of being braked by the skater without the need for braking pads or other braking expedients external to the wheels. The wheels included in these in-line skates have a composite structure whose central section is formed in whole or in part from a material having a very low coefficient of sliding friction, the central section being flanked by side sections having a relatively high coefficient of sliding friction.

The relative values of sliding friction are such that when the skates travel in the forward direction, the wheels then roll on the skating surface. But when the skater wishes to slow down or brake, he then angles the wheels of the skates with respect to the direction of forward motion, as he would when braking ice skates, thereby causing the wheels to slide on their central section while the side section frictionally engage the skating surface to slow down the slide to effect a braking action.

Since the present invention resides in a composite wheel, of prior art interest is the Klamer patent U.S. Pat. No. 5,129,702 which discloses a composite wheel for use in an in-line roller skate, a quad roller skate or as a bicycle wheel. The Klamer composite wheel has a central core of hard material and a pair of side wall bodies of soft material flanking the central core. When moving straight ahead, the Klamer wheel rides virtually only on the hard outer surface of the core body. But on curves, the softer side walls contact the ground to provide increased traction and less likelihood of slipping.

The hard, central core of the Klamer wheel is composed of a hard polyurethane which does not have a slippery outer surface and is therefore incapable of sliding on a skating surface, an essential feature of a composite wheel in accordance with the invention.

SUMMARY OF INVENTION

In view of the foregoing, the main object of this invention is to provide in-line roller skates having composite wheels which make it possible to stop or reduce speed without the need for a braking pad, a toe or heel stop, an activated disc brake, or other special expedients for this purpose.

More particularly, an object of the invention is to provide in-line roller skates that include composite wheels whose structure is such that the skater is able to stop or control-his speed using braking maneuvers similar to those executed by ice skaters without however damaging the wheels.

A significant advantage of the invention is that it takes little training to learn to brake with these in-line roller skates; hence novice skaters are able to stop or reduce speed without losing their balance.

Also an object of the invention is to provide composite wheels for in-line roller skates having a prolonged operating life that can be mass-produced at relatively low cost.

Briefly stated, these objects are attained by in-line roller skates whose composite wheels make it possible for a skater to stop without the need for a braking pad or other special expedients for this purpose. Each skate includes a boot to accommodate the skater's foot and a frame secured to the underside of the boot supporting a series of in-line wheels having a composite structure.

Each composite wheel includes a central section, a substantial portion of which is formed of a synthetic plastic material, such as ultra-high molecular weight polyethylene, having a very low coefficient of sliding friction. The central section is flanked by side sections formed of a synthetic plastic material, such as cast polyurethane, having a relatively high coefficient of sliding friction. In order to stop or reduce speed, the skater angles the in-line skates away from the direction of travel as he would when braking ice skates. The slippery central section of the composite wheel allows the wheel to slide over the skating surface in contrast to a polyurethane wheel which under normal circumstances would resist such slippage. This maneuver causes the side sections of the composite wheels, now angled with respect to the direction of travel, to frictionally engage the skating surface to effect a braking action.

The skater can gradually increase or decrease the braking action by leaning the skates to allow more or less of the side sections to frictionally engage the ground. As with ice skates, the greater the angle of declination, the higher the frictional resistance; hence the faster the stop.

BRIEF DESCRIPTION OF DRAWING

For a better understanding of the invention, as well as other objects and features thereof, reference is made to the detailed description thereof to be read in conjunction with the annexed drawing wherein.

DETAILED DESCRIPTION OF INVENTION

Basic Principles

Figure 1:
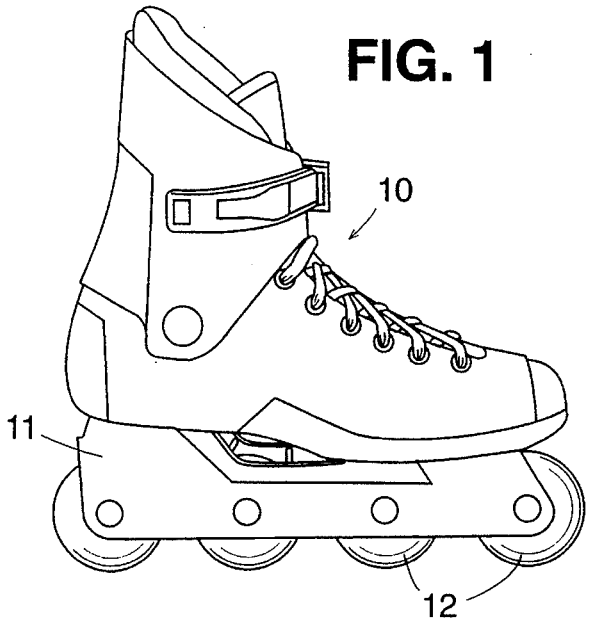
FIG. 1 illustrates in perspective an in-line roller skate having composite wheels in accordance with the invention.
Figure 2:
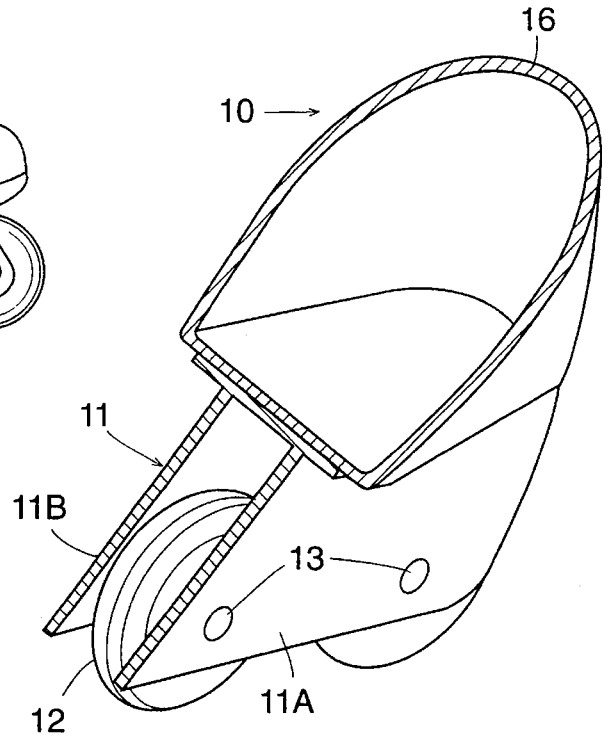
FIG. 2 is a cut-away view of the heel portion of the skate.

In an in-line roller skate in accordance with the invention, as shown in FIGS. 1 and 2, a boot 10 is provided to accommodate a foot of the skater. Attached to the underside of the boot is a frame 11 having a pair of side rails 11A and 11B for supporting a set of three or more rotatable wheels 12 in tandem relation, each wheel having a hub, adapted to receive a wheel axle 13 which bridges rails 11A and 11B.

Wheels 12 in the set have a composite structure which make it possible to brake the in-line skates in a manner similar to that by which ice skates are braked. With ice skates one is able to turn the shoes or boots away from the direction of travel, thereby increasing resistance to forward motion and reducing speed. The most commonly used stopping maneuvers with ice skates are the so called "snow plow" maneuver and the "hockey stop" maneuver.

In the "snow plow" maneuver which is the maneuver a beginner ice skater is first taught, the toe ends of the ice skates are progressively angled to point toward each other while the body weight is kept forward over the skates. As a consequence of this posture, the ice skates will scrape along the ice surface with increasing friction as more blade area is presented against the direction of travel.

The "hockey stop" maneuver which is more difficult to execute, is performed by leaning back and putting both skates almost perpendicular to the direction of travel. The resultant stopping action is more or less abrupt, depending on how far back the skater is leaning, how fast the skates are traveling and how much of the blade surface is in contact with the ice.

In-line roller skates having conventional polyurethane wheels cannot perform in the manner of ice skates even if the polyurethane wheels have a Shore A hardness as high as 88. Because these wheels which have a diameter of about 60 mm to 80 mm, exhibit a relatively high coefficient of sliding friction they therefore frictionally engage the pavement or other road surface on which the wheels ride. As a consequence, the in-line roller skater is not easily able to point the skates in any direction other than straight ahead.

With ice skates, the hockey stop is effected by turning the ice skates roughly perpendicular to the direction of forward motion, leaning backward and quickly skidding to a stop. But this maneuver cannot be safely performed with conventional in-line roller skates, for upon hitting the ground, movement would immediately be arrested, and the skater would lose control.

With in-line roller skates having composite wheels in accordance with the invention, the skater is able to come to a stop gracefully and without difficulty by executing maneuvers similar to those performed with ice skates. The composite structure of the wheels is constituted by a central section that includes material exhibiting a very low coefficient of sliding friction having a slippery outer surface and side sections flanking the central section of a material exhibiting a relatively high coefficient of sliding friction presenting a grabby outer surface which is slip resistant.

The distribution of the materials in the composite wheel is such that enough material having a slippery outer surface is in contact with the road to permit the skater to turn the skates away from the direction of forward travel gradually and thereby regulate the speed of travel. The material having a grabby outer surface makes it possible, when the skates are turned, to grab the road and generate sufficient friction to effect braking in a gradual and controllable manner.

Among the materials which are suitable for forming the central portion of a composite wheel in accordance with the invention are KEVLAR, and hard silicones, all of which have a low coefficient of sliding friction. A preferred material is UHMW (ultra-high molecular weight) polyethylene, for this material has exceptional structural strength and abrasion resistance coupled with a very low coefficient of sliding friction approaching that of TEFLON which has the lowest coefficient of sliding friction of any known material.

Among the materials which are suitable for forming the side portions of the composite wheel are thermoset or thermoplastic polyurethanes, semi-hard silicones, as well as soft elastomers. The preferred material for the side portions of the composite wheels is polyurethane having a hardness in the 78A durometer to the 85A durometer range.

Operation of The Composite Wheels

Friction is the force which resists movement of one body over another. If one body surface slides or rubs over the other and the surfaces are pressed together by a force N normal thereto, then a frictional force F must be overcome for movement to take place.

This frictional force is commonly expressed as $F=\mu N$, where $\mu$ is the coefficient of friction which is the ratio between the normal force N pressing the surfaces together and the force F required to move one surface over the other. This ratio is fairly constant, depending only on the nature of the bodies in contact with each other.

This coefficient of friction is normally considered to have two values, depending on the relative velocity of the two bodies in contact with each other. The static coefficient of friction $\mu_{static}$ represents the maximum frictional force produced when the relative velocity is zero. The kinetic or sliding coefficient of friction $\mu$kinetic represents the frictional force when the relative velocity is not zero. This is usually approximated by a single value, although there may be a velocity dependence.

In an in-line roller skate in accordance with the invention, the composite wheels include a central section a substantial portion of which is formed of a synthetic plastic material having a very low coefficient of sliding friction so that its outer surface is slippery. The central section is flanked by side sections formed of a synthetic plastic material having a higher coefficient of sliding friction providing a slip-resistant outer surface.

While hard materials usually have a lower coefficient of sliding friction than soft materials, there is no direct correlation between the degree of hardness and the coefficient of sliding friction. Thus steel is much harder than TEFLON (tetra-fluoroethylene fluorocarbon polymers), but has a significantly higher coefficient of sliding friction.

When the skates are traveling in the direction of forward motion on a skating surface, the composite wheels engaging this surface only encounter rolling friction which is effectively the same as the static coefficient of friction, and the rolling wheels then afford sufficient traction to resist slipping at the points of contact between the wheels and the road surface (asphalt, concrete, wood, plastic or any other skating surface).

But when these wheels are angled by the skater with respect to the direction of forward motion, then the rolling wheels because of their slippery central section begin to slide along the skating surface, the slide being resisted by the side sections which frictionally engage the surface to slow down the slide and brake the skates. Hence no need exists for a separate brake pad or other expedients external to the wheels to effect stopping.

The angle made by the skates relative to the direction of forward motion determines the extent to which the wheels continue to roll, for the greater the angle, the greater is the tendency of the wheels to stop rolling and to only slide on the skating surface.

Composite wheel Embodiments

Figure 3:
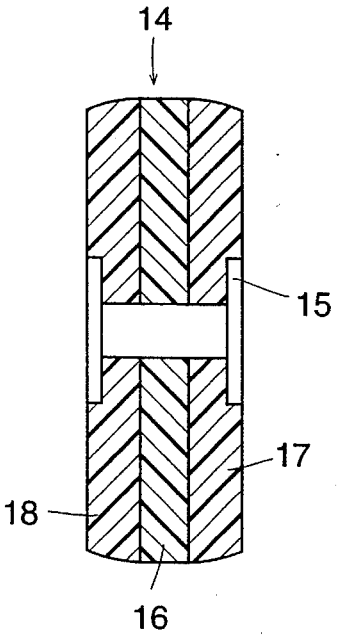
FIG. 3 is a section taken through a first preferred embodiment of a composite wheel in accordance with the invention.
Figure 4:
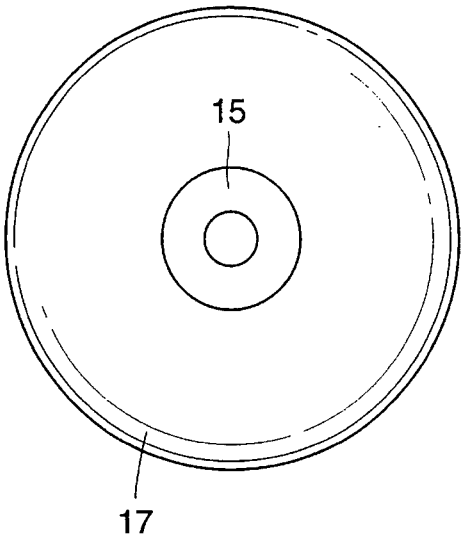
FIG. 4 is a side view of this wheel.

A firsts embodiment of a composite wheel in accordance with the invention for use in an in-line roller skate is shown in FIGS. 3 and 4. The composite wheel, generally identified by reference numeral 14, is provided at its axis of rotation with a hub 15 for accomodating an axle.

Mounted on hub 15 is a central section 16 formed of a material having a very low coefficient of sliding friction, such as UHMW polyethylene whereby the outer surface of the central section is slippery. Flanking the central section are side sections 17 and 18 whose outer edges are rounded, these sections being formed of a material, such as polyurethane having a higher coefficient of sliding friction providing a slip resistant outer surface.

In in-line skating with roller skates having composite wheels, one normally rides on the central section 16 of the wheel when traveling in the direction of forward motion. But since the rolling composite wheels engaging the skating surface only encounter rolling friction, the wheels then afford sufficient traction to resist slippage on this surface.

But when the skater leans over to stop or turn, a combination of the low-coefficient of sliding friction central section material and higher coefficient of sliding friction side section material then engages the skating surface to provide greater traction.

The high coefficient of sliding friction of the side sections are analogous to the edge of an ice skate blade, while the low coefficient of sliding friction of the central section of the wheel corresponds to the flat slippery portion of this blade which slidably engages the surface of the ice when ice skating.

When therefore the in-line skater wishes to slow down or brake as with ice skates, he then angles the in-line skates with respect to the direction of forward motion and leans over, as a consequence of which the rolling wheels then slide on their central section on the skating surface. This sliding action is resisted by the slip-resistant side section of the wheels which slow down the slide and thereby brake the skates.

Figure 5:
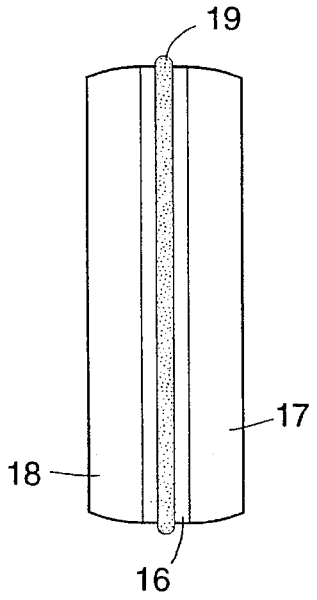
FIG. 5 is an end view of a second preferred embodiment of the composite wheel.
Figure 6:
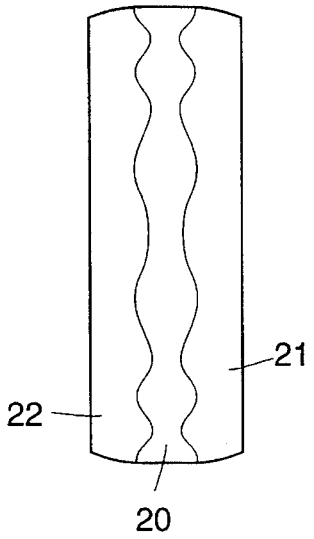
FIG. 6 is an end view of a third preferred embodiment.

To provide a smoother roll and better push off, in the modified form of composite wheel shown in FIG. 5, the slippery central section 16 of the wheel is provided at its middle with a circumferential strip 19 of a slip-resistant material.

Figure 7:
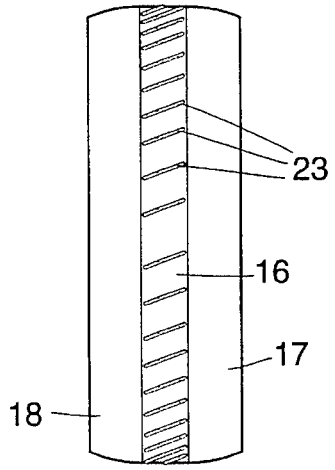
FIG. 7 is an end view of a fourth preferred embodiment.

In the embodiment of a composite wheel shown in FIG. 7 which includes a slippery central section 16 flanked by slip resistant side sections 17 and 18 as in the FIG. 3 wheel, the central section 16 is provided with a circumferential array of angled slip resistant stripes 23, these stripes serving to enhance the rolling characteristics of the wheel. In practice instead of angled stripes, the stripes may be straight.

Figure 8:
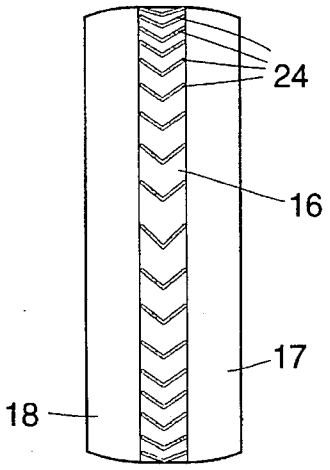
FIG. 8 is an end view of a fifth preferred embodiment.
Figure 9:
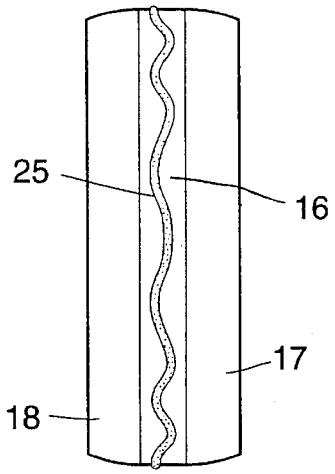
FIG. 9 is an end view of a sixth preferred embodiment.

In the embodiment of the wheel shown in FIG. 8, the slippery central section 16 of the wheel is provided with a circumferential array of chevron-shaped stripes 24 of slip-resistant material. Instead of stripes of slipresistant material, one may provide, as shown in FIG. 9, at the middle of slippery central section 16 a sinuous ring 25 of slip-resistant material. As used herein the term "slippery" refers to a material having a low-coefficient of sliding friction having a slippery outer surface which engages the skating surface, and the term "slip-resistant" refers to a material having a higher coefficient of sliding friction to provide a slip resistant outer surface.

In general, the distribution of slippery and slip-resistant materials in a composite wheel in accordance with the invention is such that the wheels become more slippery as one goes from the outer edges of the wheel toward the center thereof. The distribution of slippery and slip-resistant materials must take into account that when the wheel rides over a road surface in the forward direction, it is mainly the central portion of the wheel having a very low coefficient of sliding friction that engages this surface, a side section having a higher coefficient of sliding friction coming into play mainly when the wheel is turned to deviate from the forward direction.

Figure 10:
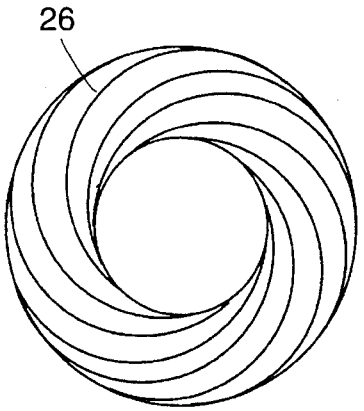
FIG. 10 is a side view of the central section of a seventh preferred embodiment of a composite wheel in accordance with the invention.

Radial rigidity determines the deformability or "bounce" of the wheel, the greater the rigidity the lesser the ride comfort. While the material in the central region of the wheel is inherently rigid, it need not be shaped so that it transfers most of its load radially inward. As shown in FIG. 10, the central section 26 of the composite wheel is preferably formed of a hard synthetic plastic material such as UHMW polyethylene having a low coefficient of sliding friction, the central section being created by a series of spiral spokes so arranged that the inner end of each spoke is angularly, displaced from the outer end to a degree significantly reducing the radial rigidity of this central section which is flanked by polyurethane or other material having a higher coefficient of friction.

Composite Wheels Having Pinwheel Core

Figure 11:
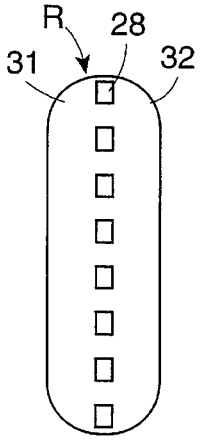
FIG. 11 is an end view of an eighth preferred embodiment of a composite wheel in accordance with the invention.
Figure 12:
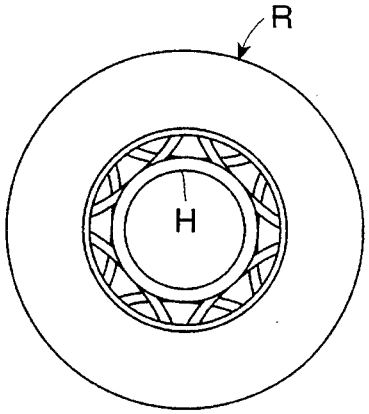
FIG. 12 is a side view of this wheel.
Figure 13:
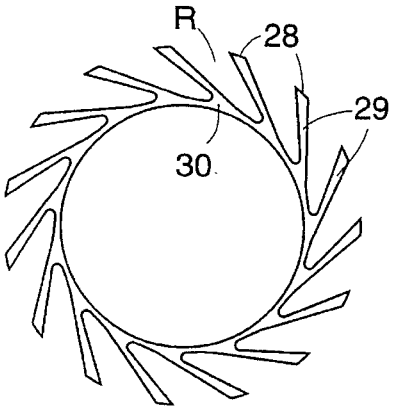
FIG. 13 is a side view of the pin wheel embedded in the central section of this composite wheel.

FIGS. 11, 12 and 13 illustrate a composite wheel for an in-line roller skate, the central section of the wheel including a circumferential series of fifteen equi-spaced exposed feet 28 formed at the free ends of an array of spokes 29 radiating tangentially from a ring 30. Ring 30 is mounted on the hub H of the wheel at its midpoint. The structure of ring 30 and spokes 29 radiating therefrom is comparable to that of a pinwheel and is molded of a synthetic plastic material having both high structural strength and a very low coefficient of sliding friction. A preferred material for the pinwheel is UHMW polyethylene or Teflon, a synthetic fluorine containing resin having an exceptionally low coefficient of sliding friction. The exposed, highly slippery surfaces of feet 28 of the wheel engage the skating surface, and when the wheel is angled with respect to the direction of forward motion, the wheel will then slide on the skating surface.

The pinwheel structure centered on the hub of the composite wheel is embedded in a rim R molded of synthetic plastic material that is of high strength and abrasion resistant, the material having a relatively high coefficient of sliding friction. A preferred material for the rim is polyurethane having a hardness in the range of about 77A durometer to 90A durometer. The degree of hardness determines the tread characteristics of the wheel to provide a proper balance of speed and traction appropriate to the skating surface. Thus the skating surface could be asphalt, concrete, wood or plastic. The choice of rim durometer depends on the nature of the surface on which the skater skates with his in-line roller skates.

The polyurethane rim fills the interstices between the spokes of the pinwheel, and flanks the central section with side sections 31 and 32 which are fully integrated with the central section. Thus the composite wheel combines the slip of the central section with the stick of the side section whereby when the skater wishes to slow down and come to a stop and to do so angles the wheels of his skates with respect to the direction of forward motion, the wheels then no longer roll but now slide on the central section, the slide being resisted by the side sections which frictionally engage the skating surface to slow down the slide.

Thus the in-line roller skater can emulate an ice skater, and effectively snow plough on an asphalt or other roller skating surface and come to a safe, controlled stop, despite the fact that the in-line skates include no toe or heel stops or activated disk brakes. It is to be noted that the composite wheel shown in FIG. 11 has a rim R with a full round radius, thereby providing consistent traction at every angle of lean.

The advantage of the pinwheel structure which forms the central section of the wheel is that the spaces between the slippery feet 28 are filled with polyurethane material which resists sliding, hence it affords the roller skater greater control of sliding motion on an in-line skating road or surface.

Figure 14:
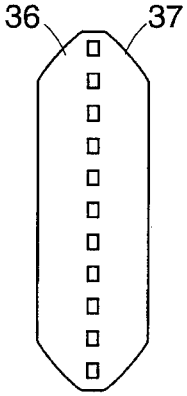
FIG. 14 is an end view of a ninth preferred embodiment of a composite wheel in accordance with the invention.
Figure 15:
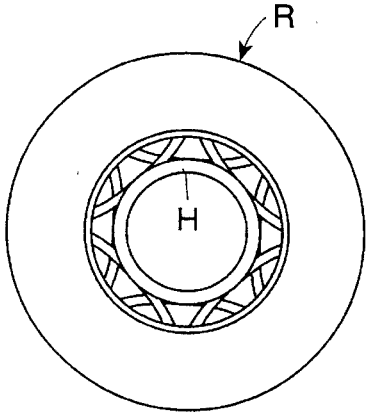
FIG. 15 is a side view of this wheel.
Figure 16:
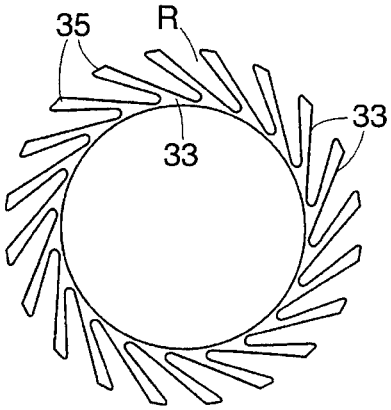
FIG. 16 is a side view of the pin wheel embedded in the central section of the composite wheel.

In the composite wheel shown in FIGS. 14, 15 and 16 the central section is formed by a pinwheel structure similar to that shown in FIG. 3, except that it includes a series of twenty spokes 33 radiating tangentially from a ring 34, the free ends of the spokes having equi-spaced flat feet 35 whose exposed surface is slippery, causing the wheel to slide when angled with respect to the direction of forward motion. The greater number of feet in the central section of this wheel affords a higher degree of slide than with a pinwheel structure having a fewer number of feet in the circumference of the central section.

The polyurethane rim R, in which the spokes are embedded has an elliptical profile and defines side sections 36 and 37 which flank the central section and are integral therewith. However, the rim in this instance does not have a full round radius as in the preceding embodiment, but a knife-edge radius, in which the side sections slope sharply downward from the central section of the wheel. This elliptical profile imparts greater maneuverability and faster acceleration to the wheel than one having a full round radius.

However, it lacks the consistent traction at every angle of lean, as in the case of a full round radius. Hence one may tailor the ring profile of a composite wheel in accordance with the invention to meet particular in-line skating requirements.

Figure 17:
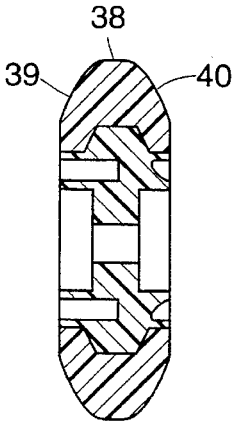
FIG. 17 shows the profile of yet another embodiment of the composite wheel.

One may, as shown in FIG. 17 provide a composite wheel that is the same as that in FIG. 14 and also has a pinwheel core, except that rim 38 of the wheel has a flat central section 38 flanked by arcuate side sections 39 and 40 to provide maximum maneuverability in long distance, high speed travel. Thus a composite wheel designed for use in an in-line skate for playing hockey, a game in which the skating player makes frequent starts and stops, many have characteristics different from wheels for long distance travel in which stops are in-frequent.

Instead of a pinwheel core, the central section of the wheel may be created by random fibers of UHMW polyethylene, or other synthetic plastic fiber having similar low coefficient of sliding friction characteristics. These fibers are dispersed and embedded in a polyurethane matrix and are exposed at the surface of the central section to render this section slippery. Or the central section may be formed by a continuous filament of UHMW polyethylene helically wound about an annular core embedded in a polyurethane rim which defines the side section of the composite wheel flanking the central section.

While there has been shown preferred embodiments of the invention, it is to be understood that many changes and modifications may be made therein without departing from the essential spirit of the invention. Thus in practice only some of the wheels in the set of in-line wheels may be composite wheels.

We claim:

1. A composite wheel for use in an in-line roller skate provided with a set of composite wheels in tandem relation mounted for rotation on a frame; said composite wheel comprising:

A. a hub adapted to receive a shaft for supporting the wheel for rotation on the frame; and B. a rim mounted on the hub consisting essentially of a central section a substantial portion of which is formed of first synthetic plastic material exhibiting a low-coefficient of sliding friction having a slippery outer surface, and side sections flanking said central section formed of a second synthetic plastic material exhibiting a higher coefficient of sliding friction, having a slip-resistant outer surface, the relative values of the coefficient of sliding friction of the first and second materials being such that the composite wheel rolls when the skate travels in the direction of forward motion and slideson the central section when the skate is angled with respect to this direction, the slide being resisted by the side sections which slow down the slide to brake the wheel, said first material being formed by a pinwheel structure mounted on the hub and having an array of spokes radiating from a ring and terminating in spaced flat feet forming said slippery outer surface.

2. A composite wheel as set forth in claim 1, in which the second material of which the side sections are formed fills the spaces between said spokes to embed the pin wheel structure therein.

3. A composite wheel as set forth in claim 1, the rim has a round profile that is an arc of a circle.

4. A composite wheel as set forth in claim 1, in which the rim has a profile defined by a flat, broad central section and arcuate side sections merging with the central sections.

5. A composite wheel as set forth in claim 1, in which the rim has a profile in which the side sections are sharply angled with respect to a narrow central section.

6. A composite wheel as set forth in claim 1, in which the first material is ultrahigh molecular weight polyethylene.

7. A composite wheel as set forth in claim 6, in which the second material is polyurethane having a Shore A hardness of at least 77.

* * * * *